US009822726B2

(12) United States Patent
Sakamoto et al.

(10) Patent No.: US 9,822,726 B2
(45) Date of Patent: Nov. 21, 2017

(54) FUEL INJECTION CONTROLLER FOR INTERNAL COMBUSTION ENGINE, AND ENGINE INCLUDING THE SAME

(71) Applicant: HONDA MOTOR CO., LTD., Minato-Ku, Tokyo (JP)

(72) Inventors: Naoki Sakamoto, Wako (JP); Yoshiaki Takeuchi, Wako (JP); Takeru Abe, Wako (JP); Yasunori Iwaya, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 767 days.

(21) Appl. No.: 14/179,793

(22) Filed: Feb. 13, 2014

(65) Prior Publication Data

US 2014/0238346 A1 Aug. 28, 2014

(30) Foreign Application Priority Data

Feb. 22, 2013 (JP) ..... 2013-033430

(51) Int. Cl.
*F02D 41/30* (2006.01)
*F02D 41/18* (2006.01)
*F02D 41/00* (2006.01)

(52) U.S. Cl.
CPC ..... *F02D 41/3005* (2013.01); *F02D 41/00* (2013.01); *F02D 41/18* (2013.01);
(Continued)

(58) Field of Classification Search
CPC ..... F02D 2200/0404; F02D 2200/0406; F02D 2200/101; F02D 41/00; F02D 41/18; F02D 41/182; F02D 41/3005; G01L 23/24
(Continued)

(56) References Cited

U.S. PATENT DOCUMENTS 4,669,438 A * 6/1987 Ishii ..... F02P 15/001 123/406.66
5,071,603 A * 12/1991 Kurumaji ..... B30B 15/20 264/328.7
(Continued)

FOREIGN PATENT DOCUMENTS

JP 08042379 A * 2/1996
JP 08042380 A * 2/1996
(Continued)

*Primary Examiner* — Hai Huynh
*Assistant Examiner* — Gonzalo Laguarda
(74) *Attorney, Agent, or Firm* — Carrier Blackman & Associates, P.C.; Joseph P. Carrier; Jeffrey T. Gedeon

(57) ABSTRACT

In a fuel injection controller, a first throttle opening TH0 is defined at a specific time P2. The P2 is a specific time later than the peak value of an intake pipe internal pressure PB of a previous cycle. In the cycle, P3 is a specific time that is set immediately before the calculation of the injection time. A second throttle opening TH2 is defined at P3. The fuel injection controller corrects a fuel injection amount based on variation in correction time ta0 at the first throttle opening TH0 to correction time ta1 at the second throttle opening TH1. The time P2 is later than time P1, which is the peak value of the intake pipe internal pressure of the previous cycle. Accordingly, the fuel injection amount correction is completely unaffected or only slightly affected by the intake pipe internal pressure, thus ensuring close-to-ideal correction.

11 Claims, 9 Drawing Sheets

(52) U.S. Cl.
CPC .... *F02D 41/182* (2013.01); *F02D 2200/0404* (2013.01); *F02D 2200/0406* (2013.01); *F02D 2200/101* (2013.01)

(58) Field of Classification Search
USPC ..... 123/295, 486, 403, 478, 673, 299, 492, 123/436; 701/104, 105, 115; 477/183; 73/114.25, 114.31, 114.32, 114.33, 73/114.36, 114.37
See application file for complete search history.

(56) References Cited

U.S. PATENT DOCUMENTS 5,619,976 A * 4/1997 Kitagawa ..... F02D 41/1402 123/679
5,657,736 A * 8/1997 Maki ..... F02D 41/0085 123/673
6,014,955 A * 1/2000 Hosotani ..... F02D 41/0002 123/399
6,550,457 B1 * 4/2003 Kitagawa ..... F02D 41/105 123/486
2002/0104520 A1 * 8/2002 Nakasaka ..... F01L 1/053 123/673
2002/0183919 A1 * 12/2002 Matsui ..... F02D 35/023 701/114
2003/0150428 A1 * 8/2003 Hozuki ..... F02D 41/2416 123/486
2004/0079341 A1 * 4/2004 Fuwa ..... F02D 41/18 123/488
2004/0159307 A1 * 8/2004 Ogawa ..... F02D 41/123 123/295
2009/0120699 A1 * 5/2009 Suzuki ..... B60L 15/2045 180/65.265
2012/0060793 A1 * 3/2012 Kim ..... F02D 41/045 123/299
2012/0323467 A1 * 12/2012 Okoshi ..... F02D 41/182 701/104
2014/0067287 A1 * 3/2014 Hagari ..... G01M 15/04 702/47
2014/0238346 A1 * 8/2014 Sakamoto ..... F02D 41/18 123/403

FOREIGN PATENT DOCUMENTS

JP 2003-106203 A 4/2003
JP 2003106203 A * 4/2003

* cited by examiner (a) STAGE
(b) INTAKE VALVE OPEN
(c) EXHAUST VALVE OPEN
(d) CALCULATE INJECTION TIME
(e) INJECTOR
(f) THROTTLE OPENING TH
(g) INTAKE PIPE INTERNAL PRESSURE PB
OLT 360°
TDC 0°
OLT 360°
TDC 0°
CLOSED
OPEN
(TH0→TH1)
TH1
TH0
TH0
TH1
P0
P1
P3
P5
MAX. INTAKE VALVE LIFT
MAX. INTAKE VALVE LIFT
PEAK INTAKE PIPE INTERNAL PRESSURE
PEAK INTAKE PIPE INTERNAL PRESSURE

FUEL INJECTION CONTROLLER FOR INTERNAL COMBUSTION ENGINE, AND ENGINE INCLUDING THE SAME

CROSS-REFERENCE TO RELATED APPLICATIONS

The present invention claims priority under 35 USC 119 based on Japanese Patent Application No. 2013-033430, filed on Feb. 22, 2013. The entire subject matter of this priority document, including specification claims and drawings thereof, is incorporated by reference herein.

BACKGROUND OF THE INVENTION

1. Field of the Invention

The present invention relates to a fuel injection controller for supplying an appropriate amount of fuel to an internal combustion engine via an injector, and to an internal combustion engine including the same. More particularly, the present invention relates a fuel injection controller which brings the fuel injection amount closer to the ideal one, and to an internal combustion engine including the same.

2. Description of the Background Art

An internal combustion engine obtains energy by igniting a gaseous mixture of fuel and air with spark plugs, and therefore must maintain the air-fuel ratio of the gaseous mixture properly. Various approaches have been proposed to determine the amount of fuel injected relative to air in a fuel-injected internal combustion engine, for example, see Japanese Patent Laid-Open No. 2003-106203, specifically FIGS. 8 and 11 thereof.

In FIG. 8 of the Japanese Patent Laid-Open No. 2003-106203, an injection instruction signal Vj shown in (B) is issued based on a pulser output shown in (A), thus allowing fuel to be injected.

During this period, a throttle opening θ changes as shown in (C).

PBmap shown in (D) is a map-searched value of intake pressure found for an engine rotary speed and a throttle opening as described in lines 5 to 7 of paragraph [0142] in the Japanese Patent Laid-Open No. 2003-106203

The value PBmap searched immediately prior to the previous synchronous injection time is used as a comparative reference value PBmap0 shown in (E) as described in lines 10 to 12 of paragraph [0142] in the Japanese Patent Laid-Open No. 2003-106203

Then, in FIG. 11 of the Japanese Patent Laid-Open No. 2003-106203, Ti shown in (A) is an actual injection time that begins at time t1. The actual injection time Ti is calculated from a reference injection time Ti0 and a correction amount Tacc.

The correction amount Tacc is determined based on a map-searched value ΔPBmap1 shown in (B). It should be noted that ΔPBmap1 is calculated as ΔPBmap1=(PBmap1−PBmap0).

In other words, the Japanese Patent Laid-Open No. 2003-106203 discloses an approach for calculating a basic injection amount and correcting the basic injection amount in order to specify a synchronous injection amount used to inject fuel in synchronism with a time around the start of an intake stroke. The approach calculates a basic injection amount based on the engine rotary speed at the time of synchronous injection and the intake volume estimated from the intake pipe vacuum pressure in the previous intake stroke. The approach corrects the basic injection amount to compensate for the change in engine load that occurs from the intake stroke of the previous cycle to the synchronous injection of the current cycle. The basic injection amount is corrected based on the difference between two load parameters, one calculated from the throttle opening at the previous synchronous injection and the other calculated from the throttle opening at the current synchronous injection.

As is apparent from the above description given in relation to FIG. 8 of the Japanese Patent Laid-Open No. 2003-106203, PBmap0 shown in (B) of FIG. 11 is a searched value at time t0. As shown in (C) of FIG. 11, the throttle opening is highly likely to change during a period from time t0 to time t1.

In other words, the change in throttle opening in the intake stroke is reflected as a change in intake pressure. Therefore, using the change in throttle opening from before the intake stroke for calculating a correction factor for the basic injection amount as in the Japanese Patent Laid-Open No. 2003-106203, leads to redundantly adding two variations (both variations), a variation in throttle opening and a variation in intake pressure resulting from the change in throttle opening. This makes it likely that the correction will deviate from an ideal one. As a result, it is necessary to fully consider the variation in intake pressure in order to establish a calculation formula and a map for the correction amount, resulting in greater likelihood of complexity and more man-hours needed for experiments.

Against the backdrop of quest for engines with higher performance, a fuel injection controller is desired which can bring the fuel injection amount closer to the ideal one.

The present invention has been made to overcome such drawbacks of the existing fuel injection controller. Accordingly, it is one of the objects of the present invention to provide a fuel injection controller which is capable of bringing the fuel injection amount closer to the ideal one.

SUMMARY OF THE INVENTION

In order to achieve the above objects, the present invention according to a first aspect thereof provides a fuel injection controller including a basic fuel injection amount calculator and a fuel injection amount corrector. The basic fuel injection amount calculator calculates a basic fuel injection amount for fuel drawn in the intake stroke of a current cycle based on an engine rotary speed and an intake pipe internal pressure in the intake stroke of a previous cycle. The fuel injection amount corrector makes a correction to the basic fuel injection amount based on variations in two factors. One of these two factors is a throttle opening immediately before the calculation of the basic fuel injection amount. This throttle opening immediately before the calculation of the basic fuel injection amount is denoted by TH1 (also referred to as a second throttle opening TH1). The other of the two factors is a throttle opening before then, i.e., prior to the throttle opening TH1. This throttle opening is denoted by TH0 (also referred to as a first throttle opening TH0).

The fuel injection amount corrector makes the correction using the first throttle opening TH0, which is a throttle opening at or after the maximum lift of an intake valve in the intake stroke of the previous cycle.

The present invention according to a second aspect thereof is characterized in that the intake pipe internal pressure of the previous cycle takes on a peak value of the intake pipe internal pressure; and that the first throttle opening TH0 is set to a time later than the peak value.

The present invention according to a third aspect thereof is characterized in that the first throttle opening TH0 is set to the throttle opening at or after the full closing of the intake valve in the previous cycle.

The present invention according to a fourth aspect thereof is characterized in that when fuel is injected twice per cycle of the engine, a first fuel injection amount including the basis fuel injection amount and the correction to the basic fuel injection amount is a first injection conducted at an early stage of the intake stroke of the current cycle or at a stage earlier than the intake stroke. A fuel injector performs a second injection later than the first injection and during the intake stroke of the current cycle. The injection amount for the second injection is found based on variations in two factors, the TH1 and TH2 which will be defined next. The TH2 takes on the throttle opening at or before the maximum lift of the intake valve.

The present invention according to a fifth aspect thereof is characterized in that the fuel injection is a first injection conducted at an early stage of the intake stroke of the current cycle or at a stage earlier than the intake stroke. The fuel injector performs a second injection later than the first injection and during the intake stroke of the current cycle. In the first injection, the intake pipe internal pressure (PB) in the intake stroke of the previous cycle takes on the peak value of the intake pipe internal pressure. The injection amount for the second injection is found based on variations in the TH1 and the TH2. The TH2 takes on the throttle opening at or before the peak value of the intake pipe internal pressure (PB).

The present invention according to a sixth aspect thereof is characterized in that a common throttle opening map (Mp) or a formula is used for determining the correction to first fuel injection amount in the first injection and a correction to the second fuel injection amount in for the second injection.

Effects of the Invention

According to the first aspect of the present invention, a calculation is made for correction based on a throttle opening at the maximum lift of an intake valve. This makes it possible to determine the change in throttle opening in a range other than that where a throttle pressure changes significantly as a result of the change in throttle opening. As a result, it is possible to prevent two variations, one in throttle opening and the other in intake pressure resulting from change in throttle opening, from redundantly affecting the correction. This allows calculating a close-to-ideal correction amount.

Accordingly, the present invention provides a fuel injection controller capable of bringing the fuel injection amount closer to the ideal one. Further, the present invention provides reduced man-hours needed for experiments.

According to the second aspect of the present invention, a throttle opening TH0 is used. The TH0 is the throttle opening at a time later than a peak value of an intake pipe internal pressure. This minimizes change in intake pipe internal pressure resulting from change in throttle opening afterwards. That is, the correction is completely unaffected or only slightly affected by the peak value of the intake pipe internal pressure, if affected at all, thus ensuring close-to-ideal correction.

According to the third aspect of the present invention, the intake valve is fully closed. Therefore, the correction is completely unaffected by the change in intake pipe internal pressure. As a result, it is possible to bring the variation close to the ideal one with ease.

According to the fourth aspect of the present invention, the fuel injection is twofold; first and second injections. In particular, the second injection uses a throttle opening TH2 at or before the maximum lift of the intake valve. At this moment, the change in intake pipe internal pressure is at an early stage and small. That is, the correction is completely unaffected or only slightly affected by the intake pipe internal pressure, if affected at all, thus ensuring close-to-ideal correction.

According to the fifth aspect of the present invention, the fuel injection is twofold; the first and second injections. In particular, the second injection uses the throttle opening TH2 at or before the peak value of the intake pipe internal pressure. At this moment, the change in intake pipe internal pressure is at an early stage and small. That is, the correction is completely unaffected or only slightly affected by the peak value of the intake pipe internal pressure, if affected at all, thus ensuring close-to-ideal correction.

According to the sixth aspect of the present invention, both the first and second injections are unaffected by the intake pipe internal pressure. This makes it possible to use the same throttle opening map for the first and second injections. Therefore, only one throttle opening map is needed to determine the injection amounts. The present invention halves the cost of map preparation as compared to separate preparation of correction maps for the first and second injections. Further, this requires only half as many memories to store the throttle opening map, thus contributing to a reduced cost of a storage section.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An illustrative embodiment of the present invention will be described hereinafter in detail with reference to the accompanying drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

The fuel injection control according to the first aspect of the present invention will be described based primarily on FIG. 2. Similarly, the second aspect of the present invention will be described based on FIG. 4, the third aspect based on FIG. 6, the fourth aspect based on FIG. 7, the fifth aspect based on FIG. 8, and the sixth aspect based on FIG. 9.

Illustrative Embodiments

Figure 1:
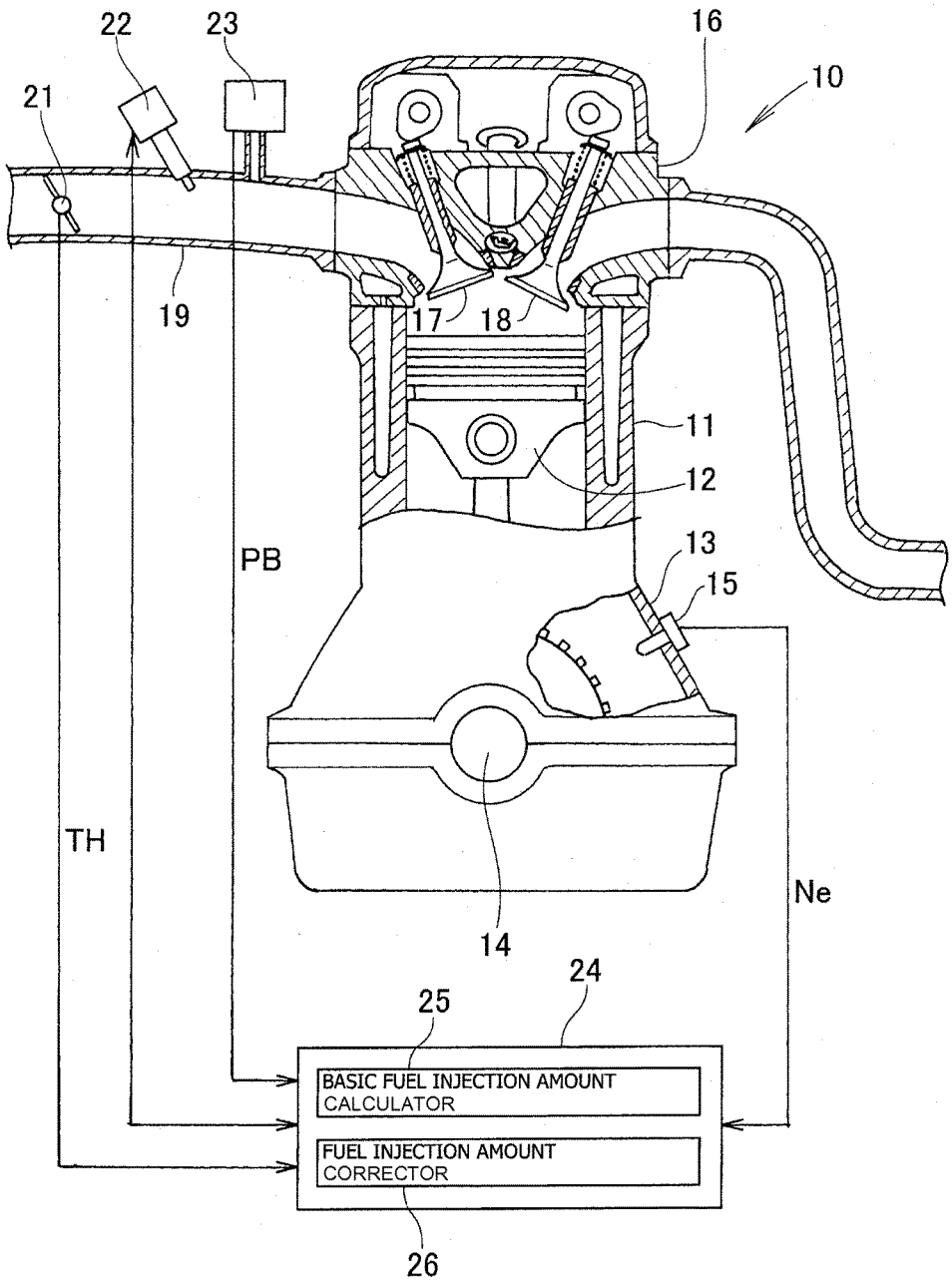
FIG. 1 is a basic configuration diagram of an engine including a fuel injection controller according to the present invention.

As illustrated in FIG. 1, an engine 10 includes a cylinder block 11 and a piston 12 arranged in the cylinder block 11. The engine 10 further includes, in a crankcase 13, a pulse sensor 15 which measures the rotary speed (i.e., engine rotary speed) of a crankshaft 14. The engine 10 still further includes an intake valve 17 and an exhaust valve 18 in a cylinder head 16. The engine 10 further includes an intake pipe 19 having a throttle valve 21, an injector 22, and a pressure sensor 23 arranged in this order therein along the flow of introduced air. Further, the engine 10 includes a fuel injection controller 24.

The fuel injection controller 24 obtains information about an engine rotary speed Ne from the pulse sensor 15 and a throttle opening TH from the throttle valve 21. The fuel injection controller 24 further obtains an intake pipe internal pressure PB from the pressure sensor 23. The fuel injection controller 24 controls the injector 22 based on various inputs, e.g., an engine rotary speed Ne, a throttle opening TH and an intake pipe internal pressure PB.

The fuel injection controller 24 includes a basic fuel injection amount calculator 25. The basic fuel injection amount calculator 25 calculates a basic fuel injection amount based on the engine rotary speed Ne and the intake pipe internal pressure PB in the intake stroke of a previous cycle. The fuel injection controller 24 also includes a fuel injection amount corrector 26.

The fuel injection amount corrector 26 corrects the basic fuel injection amount based on variations in two factors. One of these two factors is a throttle opening immediately before the calculation of the basic fuel injection amount. This throttle opening is denoted by TH1. The other of these two factors is a throttle opening in a specified timing before then. This throttle opening is denoted by TH0.

A detailed description of the action of the fuel injection controller 24 is discussed below based on FIG. 2.

Figure 2:
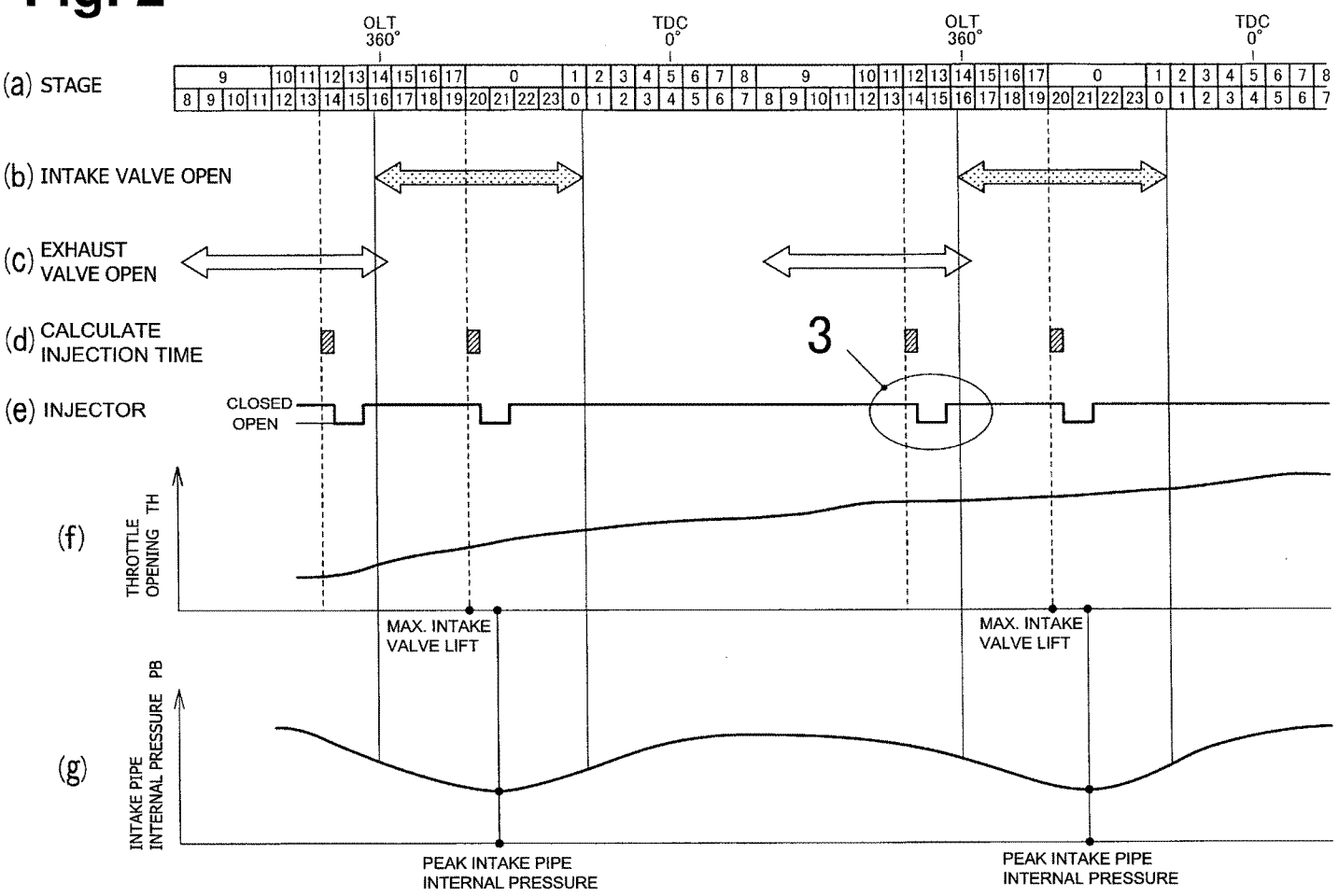
FIG. 2 is a timing chart describing fuel injection control.

In FIG. 2, (a) illustrates an absolute stage and a relative injection stage, one on top of the other, that are determined based on a pulse input from the pulse sensor; (b) illustrates an opening range of the intake valve; (c) illustrates an opening range of the exhaust valve; (d) illustrates calculation periods of injection time; (e) illustrates closed (non-injection) and open (injection) periods of the injector; (f) illustrates an example of change in the throttle opening TH; and (g) illustrates an example of change in the intake pipe internal pressure PB.

The intake valve protrudes the most into the combustion chamber while the intake valve shown in (b) is open (equivalent to the intake stroke) as illustrated in (f). That is, the intake valve reaches the maximum lift. This moment will be hereinafter referred to as 'the maximum lift of the intake valve.'

Further, the piston moves down in the intake stroke. As a result, the intake pipe internal pressure PB is sucked by the piston, causing the intake pipe internal pressure PB to decline. This brings the intake pipe internal pressure PB down to the minimum level near the center of the intake stroke as illustrated in (g). This moment will be hereinafter referred to as 'the peak intake pipe internal pressure.' The peak intake pipe internal pressure tends to occur slightly after the maximum lift of the intake valve.

In the injection time calculation shown in (d), the fuel injection controller 24 shown in FIG. 1 calculates the corrected injection.

Figure 3:
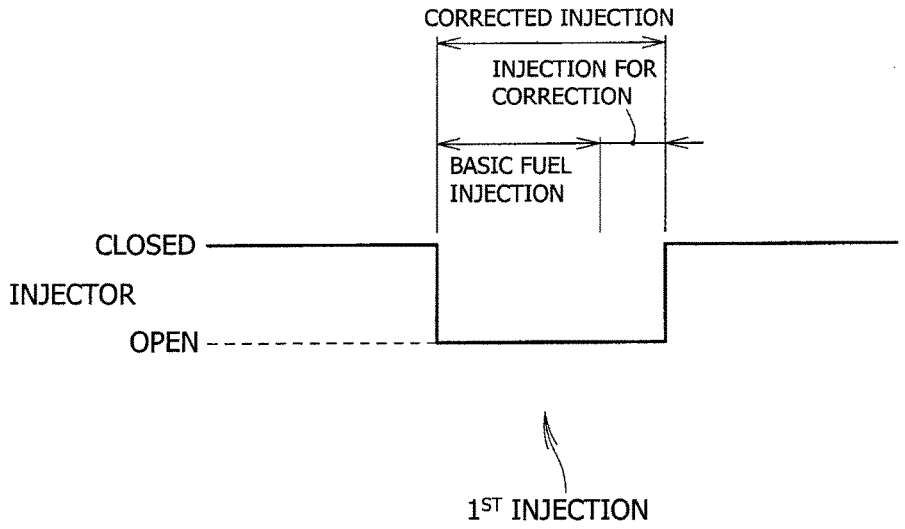
FIG. 3 is an enlarged view of area 3 in FIG. 2.

As illustrated in FIG. 3, an enlarged view of area 3 in FIG. 2, the corrected injection time is calculated by adding a variation to or subtracting it from the basic fuel injection time. A detailed description will be given below of this calculation with reference to FIG. 3 onward. It may be noted that the internal diameter of the injection hole of the injector is constant. Therefore, the injection amount is approximately proportional to the injection time. Consequently, the term 'injection time' can be replaced by the term 'injection amount' and vice versa. Practically, when the valve closes from an open position or opens from a closed position, the flow rate will change. Therefore, the time and the amount do not precisely agree, which requires separate correction. However, a description thereof is omitted here.

The basic fuel injection time (amount) is calculated by the basic fuel injection amount calculator 25 based on the engine rotary speed and the peak value of the intake pipe internal pressure PB of the previous cycle.

Figure 4:
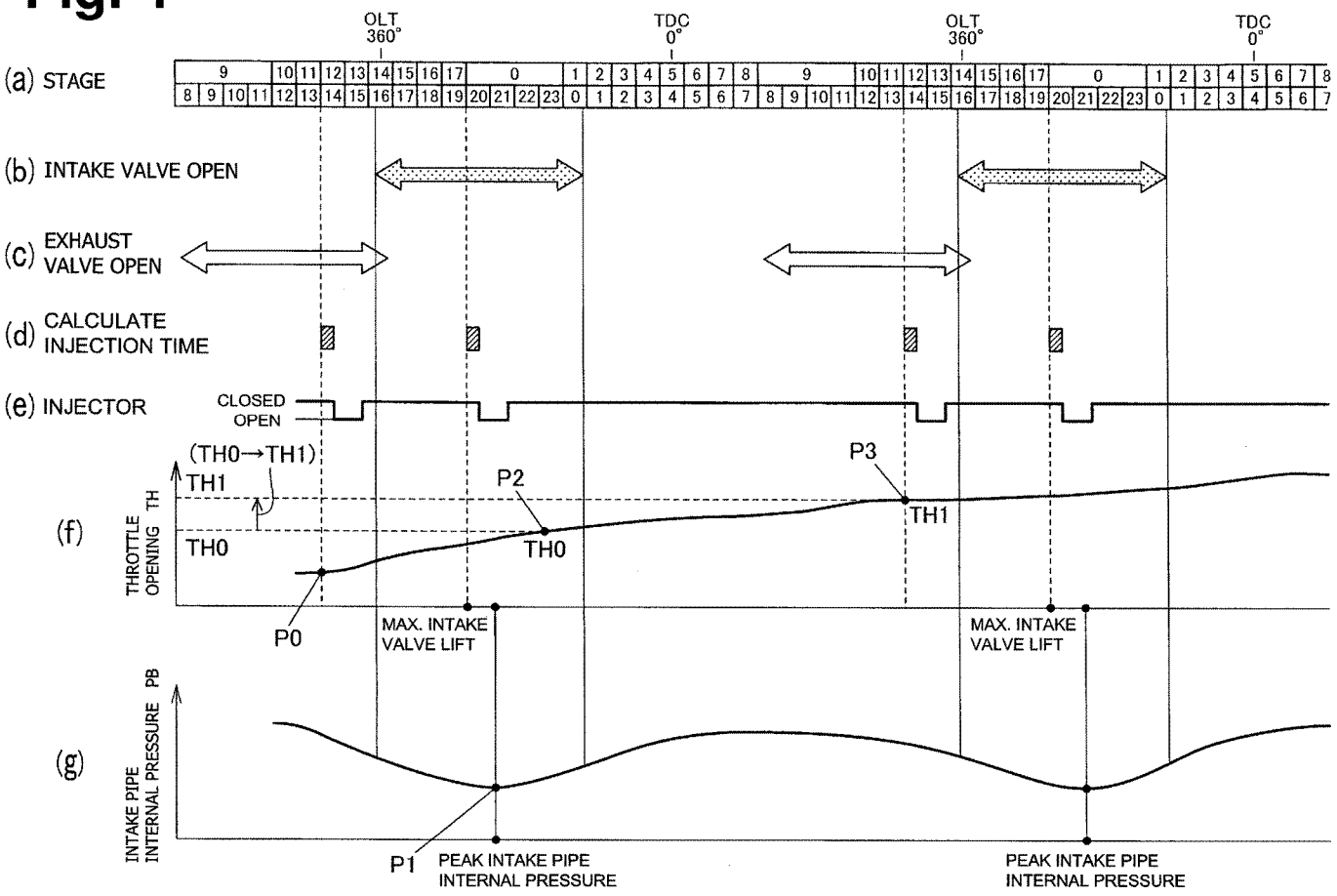
FIG. 4 is a diagram describing an embodiment of fuel injection control.

In FIG. 4, the peak value of the intake pipe internal pressure PB of the previous cycle is the intake pipe internal pressure represented by point P1.

It should be noted, however, that because the intake pipe internal pressure PB of the previous cycle is used, this pressure is probably slightly different from the intake pipe internal pressure in the current cycle. Therefore, this pressure must be corrected.

For this reason, in FIG. 4, at intake pipe internal pressure P2, the throttle opening is TH0. Again, in FIG. 4, P2 is a specific time later than the peak value of the intake pipe internal pressure PB of the previous cycle (e.g., P1).

Further, P3 is a specific point that is set immediately before the calculation of the injection time shown by a rectangle filled with diagonal lines. At the intake pipe internal pressure P3, the throttle opening is TH1.

In this manner, the throttle openings TH1 and TH0 are defined.

Figure 5:
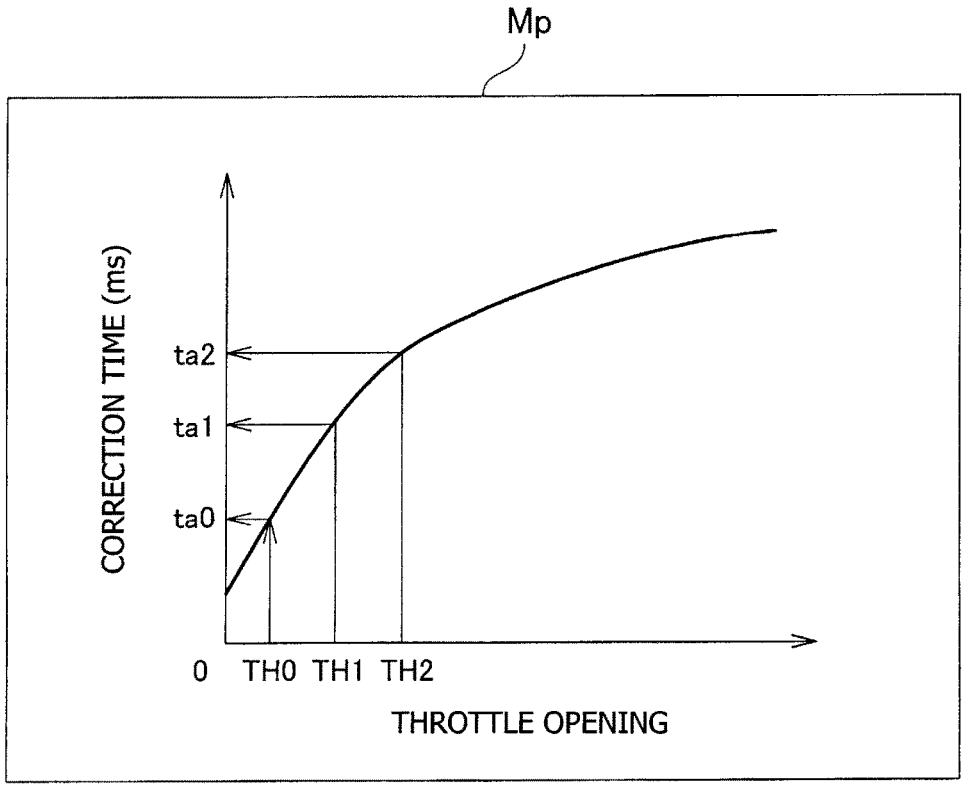
FIG. 5 is a diagram describing another embodiment of fuel injection control.

FIG. 5 is a diagram illustrating a throttle opening map. The fuel injection amount corrector 26 (FIG. 1) reads a correction time ta0 for the throttle opening TH0 using a throttle opening map Mp (or a formula (including approximation formula)), thus finding a correction time ta1 for the throttle opening TH1. Then, the fuel injection amount corrector 26 acknowledges the change in correction time (ta0 to ta1) as a variation.

The corrected injection time as shown in FIG. 3, i.e., the fuel injection amount, is determined from two factors. One of these two factors is the basic fuel injection time calculated by the basic fuel injection amount calculator 25 (FIG. 1). The other of these two factors is the variation determined by the fuel injection amount corrector 26 (FIG. 1). As a result, fuel is injected only for this period of time.

In FIG. 4, the prior art used the value at point P0 as TH0. However, this causes the change in throttle opening to significantly affect the intake pipe internal pressure shown in (g) (FIG. 4). As a result, the correction is likely to deviate excessively from the ideal one. In contrast, according to the present invention, the correction is completely unaffected or only slightly affected by the intake pipe internal pressure, if affected at all, thus ensuring close-to-ideal correction.

A description will be given of modification examples of FIG. 4 with reference to FIGS. 6 and 7 in this order.

Figure 6:
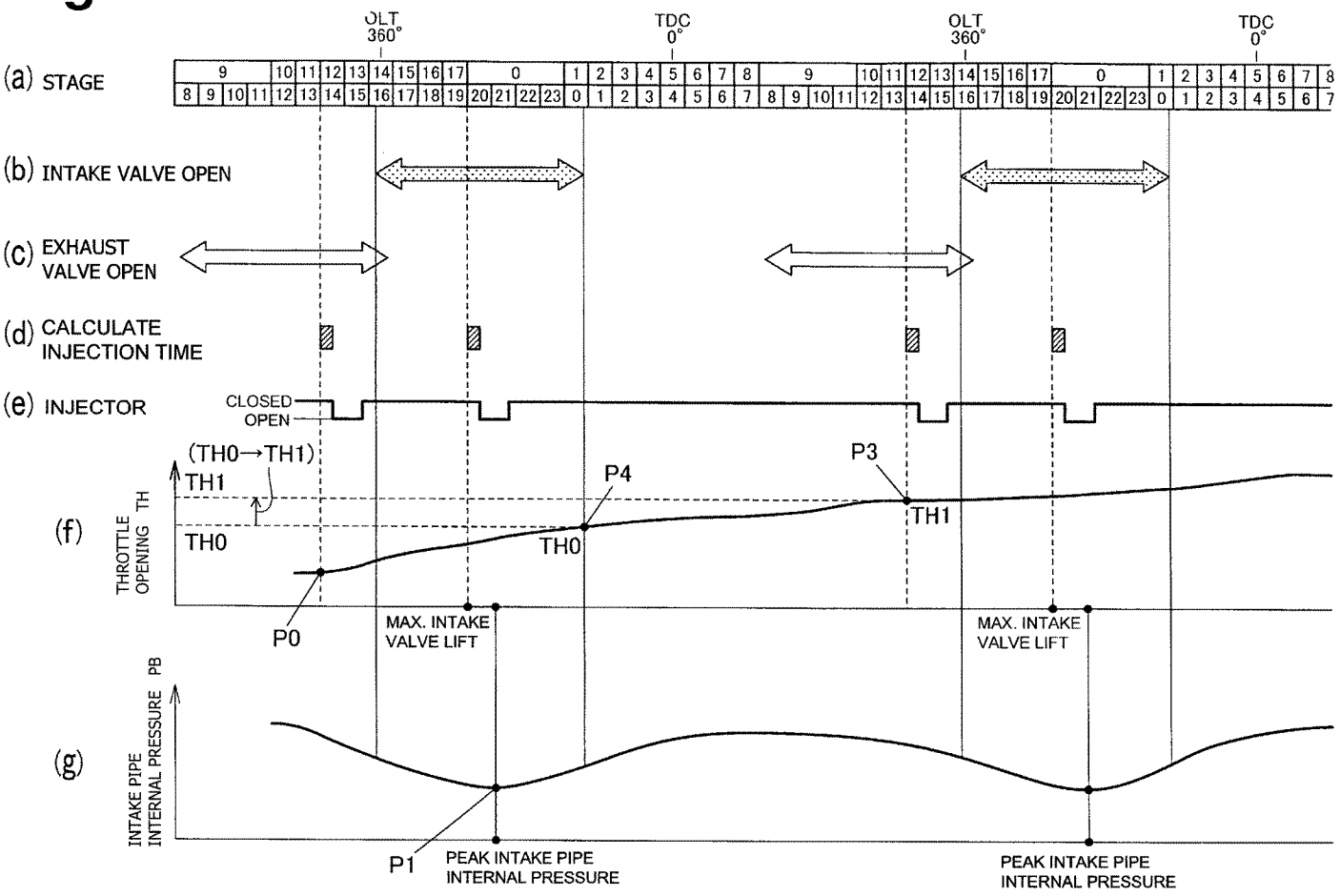
FIG. 6 is a diagram illustrating an example of a throttle opening map used in the present invention.

TH0 is the throttle opening when the intake valve closes in the previous cycle (point P4) as illustrated in FIG. 6. FIGS. 6 and 7 are identical to FIGS. 4 and 5 in all other respects. Therefore, the identical description thereof is omitted.

It may be noted that point P4 may be later than the position shown in FIG. 6, i.e., later than the closing of the intake valve. It is more preferred that the point P4 should be immediately after the closing of the intake valve.

As compared to FIG. 4, the intake pipe internal pressure remains completely unaffected by the change in throttle opening afterwards due to the closing of the intake valve as illustrated in FIG. 6. This is advantageous in that the variation can be readily brought close to the ideal one.

Figure 7:
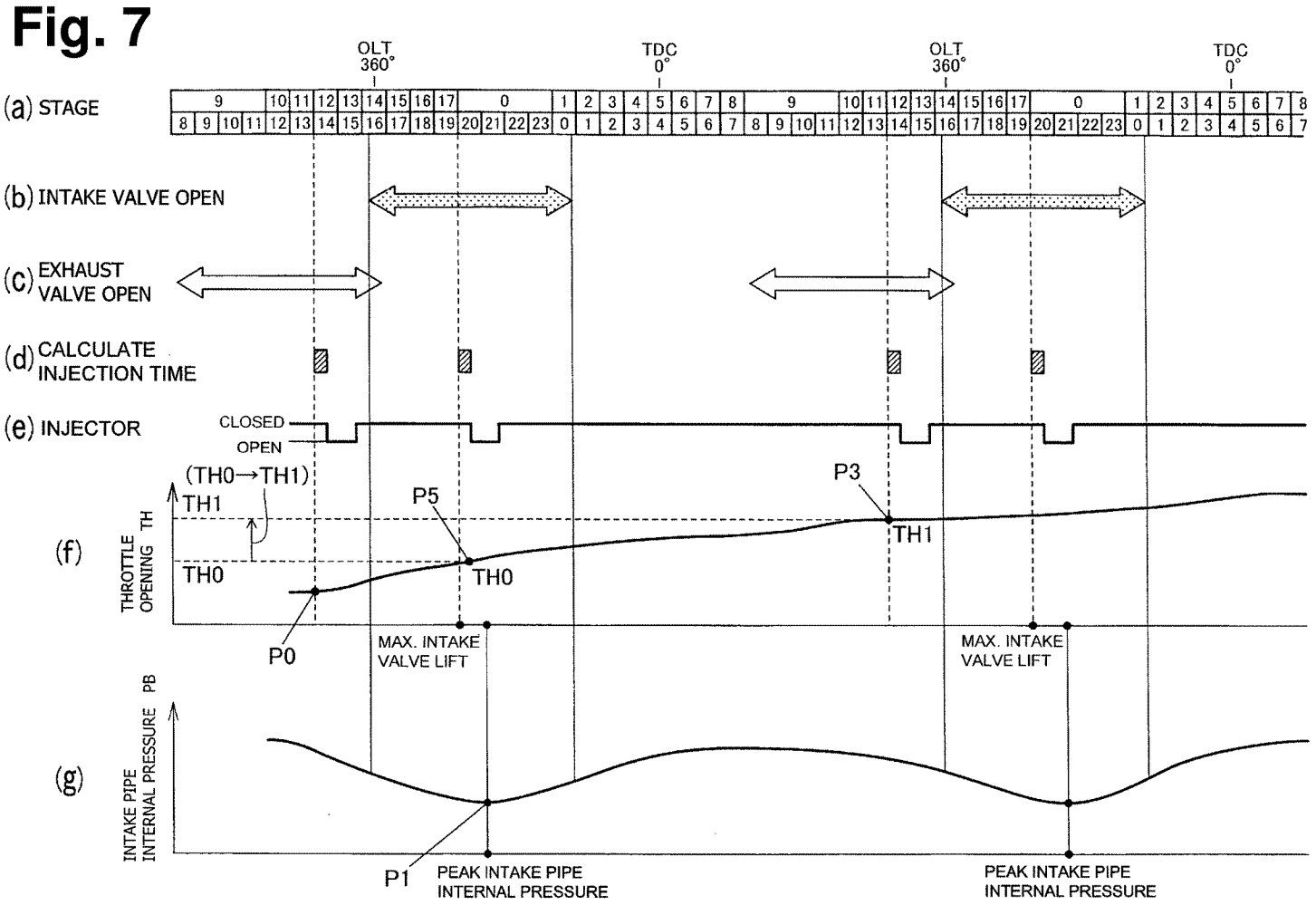
FIG. 7 is a diagram describing still another embodiment of fuel injection control.

In FIG. 7, throttle opening TH1 is set again to the throttle opening immediately before the calculation of the basic injection amount (point P3). On the other hand, TH0 is set to the throttle opening at or after the maximum lift of the intake valve of the engine (point P5).

Then, the basic fuel injection amount is corrected based on variations for throttle openings TH0 and TH1.

In FIG. 7, the correction is partially affected by the change in intake pipe internal pressure, but not as much as in the prior art (in which the correction is totally affected by the change in intake pipe internal pressure because the throttle opening TH0 is set to the throttle opening at point P0).

The present invention as described above is suitable for application to engines that inject fuel once per cycle.

A description will be given next of an example in which fuel is injected twice per cycle.

Figure 8:
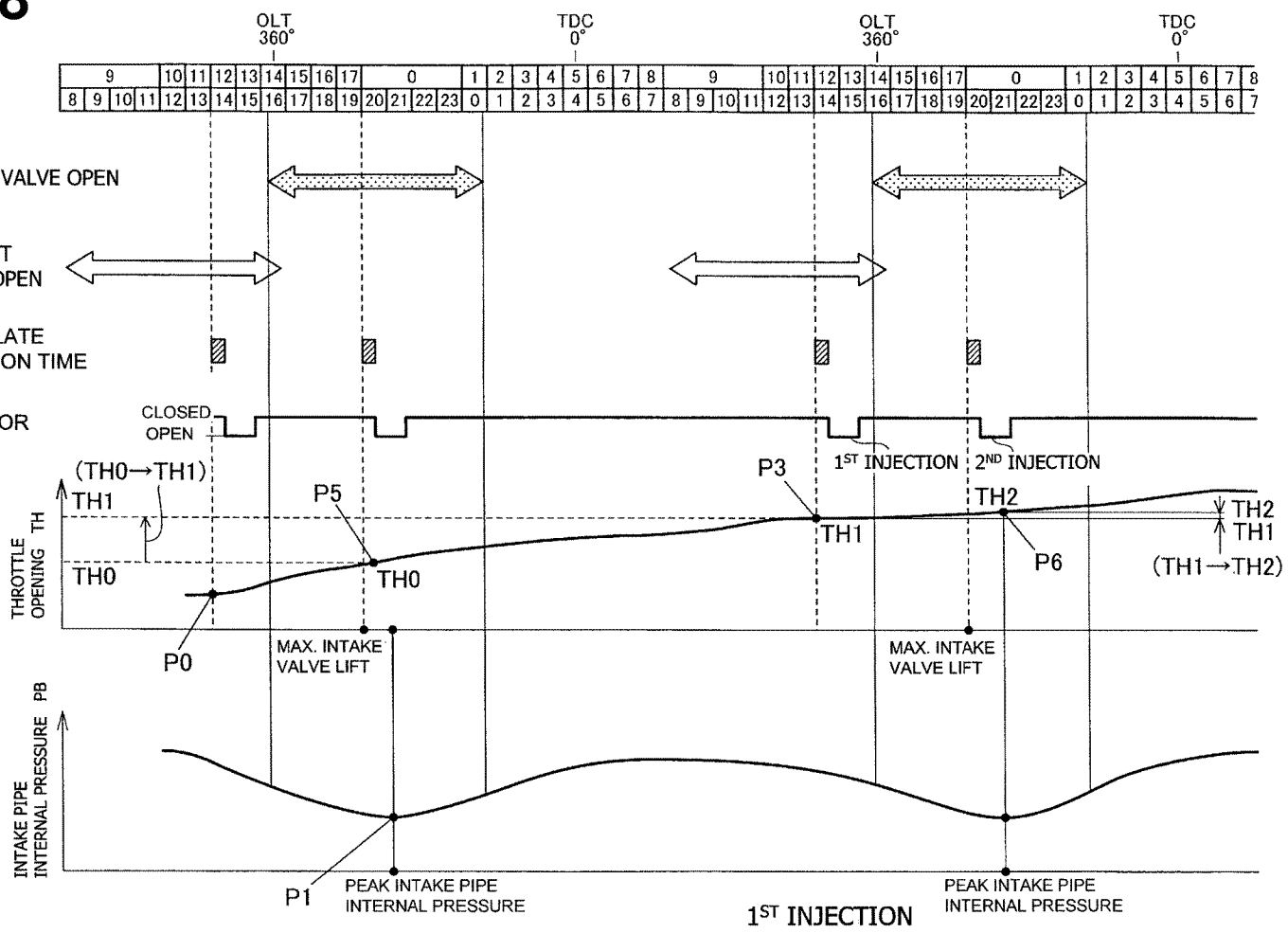
FIG. 8 is a diagram describing still another embodiment of fuel injection control.

As illustrated in (e) of FIG. 8, a first injection is conducted at an early stage of the intake stroke or at a stage prior to the intake stroke. A second injection is conducted later than the first injection and during the intake stroke.

In the first injection, the peak value of the intake pipe internal pressure PB of the previous cycle, i.e., PB at point P1, is used as the intake pipe internal pressure PB thereof, as with FIGS. 4 to 7.

Then, TH1 is set to the throttle opening immediately before the calculation of the basic injection amount (point P3) in the correction for the first injection, as with FIG. 7. On the other hand, TH0 is set to the throttle opening at or after the maximum lift of the intake valve of the engine (point P5).

Then, the basic fuel injection amount is corrected based on variations for TH0 and TH1 using the throttle opening map Mp shown in FIG. 5.

Further, point P6 is set to a time at or before the peak value of the intake pipe internal pressure. Then, the throttle opening at point P6 is defined as TH2. Then, the correction amount for the second injection is found based on variations for TH1 and TH2 using the throttle opening map Mp shown in FIG. 5.

It is even better if point P6 is located immediately before the peak value of the intake pipe internal pressure (PB).

A modification example of FIG. 8 will be described with reference to FIG. 9.

Figure 9:
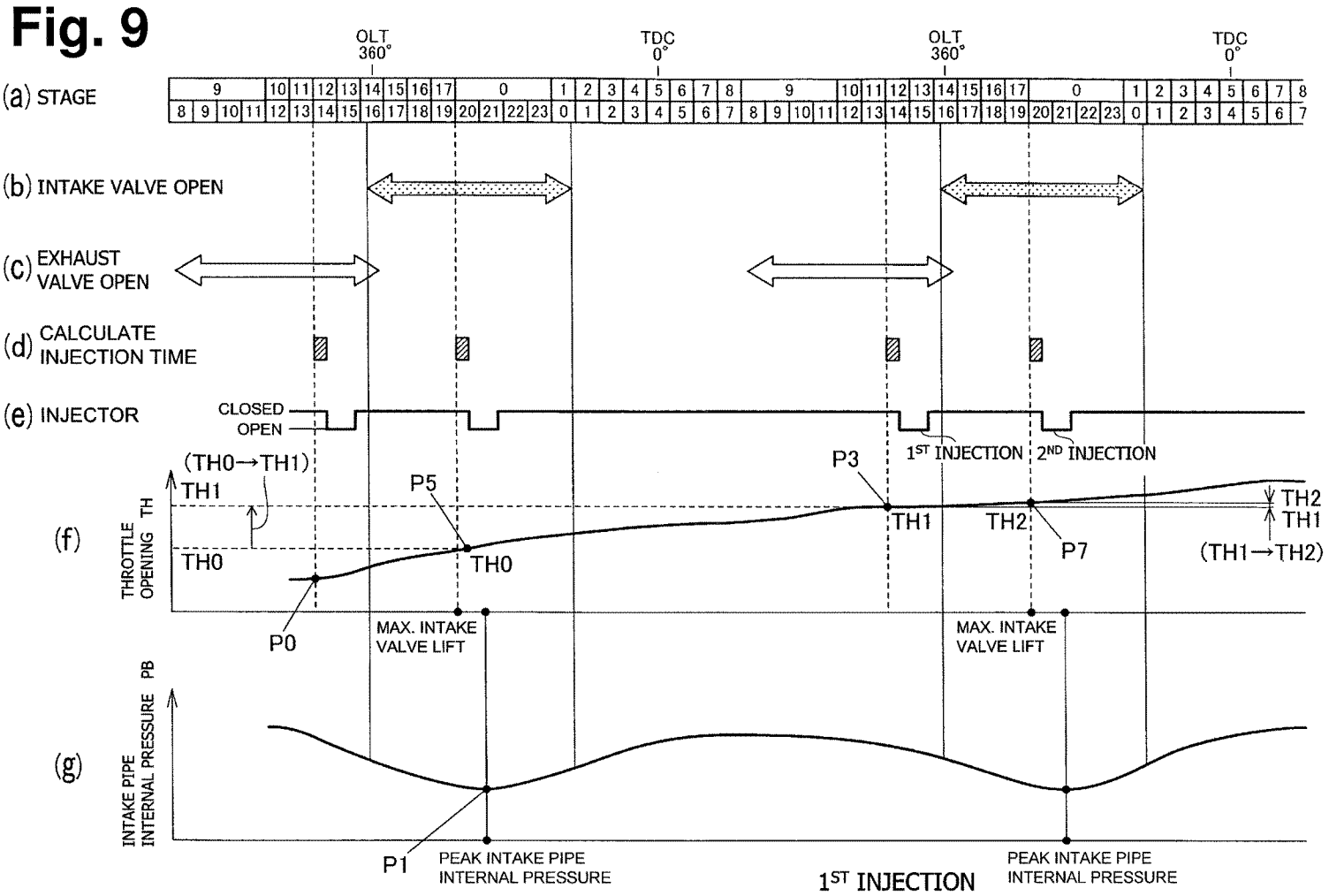
FIG. 9 is a diagram describing still another embodiment of fuel injection control.

In FIG. 9, the first injection is conducted at an early stage of the intake stroke or at a stage prior to the intake stroke, and the second injection is conducted later than the first injection and during the intake stroke, as with FIG. 8.

In the first injection, the peak value of the intake pipe internal pressure PB of the previous cycle, i.e., PB at point P1, is used as the intake pipe internal pressure PB thereof, as with FIG. 8 (i.e., as with FIGS. 4 to 7).

Then, TH1 is set to the throttle opening immediately before the calculation of the basic injection amount (point P3) in the correction for the first injection, as with FIG. 7. On the other hand, TH0 is set to the throttle opening at or after the maximum lift of the intake valve of the engine (point P5).

Then, the basic fuel injection amount is corrected based on variations for TH0 and TH1 using the throttle opening map Mp shown in FIG. 5.

Further, point P7 is set to a time at or before the maximum lift of the intake valve. Then, the throttle opening at point P7 is defined as TH2. Then, the injection amount for the second injection is obtained as a variation (ta2−ta1) for TH1 and TH2 using the throttle opening map Mp shown in FIG. 5.

It is even better if point P7 is located immediately before the maximum lift.

As described above, a common throttle opening map Mp (FIG. 5) is used in the correction for the first injection and the determination for the second injection. Sharing a throttle opening map halves the cost of map preparation as compared to separate preparation of correction maps for the first and second injections. Further, this requires only half of the memory capacity to store the throttle opening map, thus contributing to a reduced cost of a storage section.

INDUSTRIAL APPLICABILITY

The present invention is suitable for application to an engine having an injector.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

DESCRIPTION OF REFERENCE SYMBOLS

10: Engine, 15: Pulse sensor, 17: Intake valve, 21: Throttle valve, 22: Injector, 23: Pressure sensor, 24: Fuel injection controller, 25: Basic fuel injection amount calculator, 26: Fuel injection amount corrector, Ne: Engine rotary speed, PB: Intake pipe internal pressure, TH, TH1: Throttle openings, TH0: Throttle opening before TH1, TH2: Throttle opening after TH1, Mp: Throttle opening map.

What is claimed is:

1. A fuel injection controller for an engine, said fuel injection controller comprising:

a basic fuel injection amount calculator which calculates a basic fuel injection amount for a fuel injector to be drawn in an intake stroke of a current cycle based on an engine rotary speed from an engine rotary speed sensor and an intake pipe internal pressure PB from a pressure sensor in an intake stroke of a previous cycle;

a fuel injection amount corrector which makes a correction to the basic fuel injection amount based on variations in a first throttle opening TH0; and a second throttle opening TH1, which occurs immediately before the calculation of the basic fuel injection amount, wherein the first throttle opening TH0 occurs before the second throttle opening TH1;

wherein the fuel injection amount corrector makes the correction to the basic fuel injection amount using the first throttle opening TH0, which is set to one of the throttle opening at and after the maximum lift of an intake valve in the intake stroke of the previous cycle, wherein the intake pipe internal pressure PB of the previous cycle takes on a peak value of the intake pipe internal pressure PB, wherein the first throttle opening TH0 is set to a time later than the peak value of the intake pipe internal pressure PB, and wherein when fuel is injected twice per cycle of the engine:

a first fuel injection amount including the basic fuel injection amount and said correction to the basic fuel injection amount is a first injection conducted at an early stage of the intake stroke of the current cycle or at a stage earlier than the intake stroke, and the fuel injector further performs a second injection later than the first injection and during the intake stroke of the current cycle;

a second fuel injection amount for the second injection is determined based on variations in the second throttle opening TH1, and a third throttle opening TH2 which is defined subsequent to the second throttle opening TH1; and the third throttle opening TH2 is one of a throttle opening at and before the maximum lift of the intake valve.

2. The fuel injection controller of claim 1, wherein the first throttle opening TH0 is set to the throttle opening at or after the full closing of the intake valve in the previous cycle.

3. The fuel injection controller of claim 2, wherein when fuel is injected twice per cycle of the engine:

a first fuel injection amount including the basic fuel injection amount and said correction to the basic fuel injection amount is a first injection conducted at an early stage of the intake stroke of the current cycle or at a stage earlier than the intake stroke, and a fuel injector further performs a second injection later than the first injection and during the intake stroke of the current cycle;

a second fuel injection amount for the second injection is determined based on variations in the second throttle opening TH1, and a third throttle opening TH2 which is defined subsequent to the second throttle opening TH1; and the third throttle opening TH2 is one of a throttle opening at and before the maximum lift of the intake valve.

4. The fuel injection controller of claim 1, wherein when fuel is injected twice per cycle of the engine:

a first fuel injection amount including the basic fuel injection amount and said correction to the basic fuel injection amount is a first injection conducted at an early stage of the intake stroke of the current cycle or at a stage earlier than the intake stroke, and the fuel injector further performs a second injection later than the first injection and during the intake stroke of the current cycle;

in the first injection, the intake pipe internal pressure PB in the intake stroke of the previous cycle takes on the peak value of the intake pipe internal pressure;

a second fuel injection amount for the second injection is determined based on variations in the second throttle opening TH1, and third throttle opening TH2 which is defined subsequent to the second throttle opening TH1; and the third throttle opening TH2 is one of the throttle opening at and before the peak value of the intake pipe internal pressure PB.

5. The fuel injection controller of claim 1, wherein one of a common throttle opening map Mp and a formula is used for determining said correction to the first fuel injection amount in the first injection, and a correction to the second fuel injection amount for the second injection.

6. The fuel injection controller of claim 4, wherein one of a common throttle opening map Mp and a formula is used for determining said correction to the first fuel injection amount in the first injection, and a correction to the second fuel injection amount for the second injection.

7. An internal combustion engine, comprising a basic fuel injection amount calculator which calculates a basic fuel injection amount for a fuel injector to be drawn in an intake stroke of a current cycle based on an engine rotary speed from an engine rotary speed sensor and an intake pipe internal pressure PB from a pressure sensor in an intake stroke of a previous cycle; and a fuel injection amount corrector which makes a correction to the basic fuel injection amount based on variations in a first throttle opening TH0; and a second throttle opening TH1, which occurs immediately before the calculation of the basic fuel injection amount, wherein the first throttle opening TH0 occurs before the second throttle opening TH1; and wherein the fuel injection amount corrector makes the correction to the basic fuel amount using the first throttle opening TH0, which is set to one of the throttle opening at and after the maximum lift of an intake valve in the intake stroke of the previous cycle, wherein the intake pipe internal pressure PB of the previous cycle takes on a peak value of the intake pipe internal pressure PB, wherein the first throttle opening TH0 is set to a time later than the peak value of the intake pipe internal pressure PB, and wherein when fuel is injected twice per cycle of the engine:

a first fuel injection amount including the basic fuel injection amount and said correction to the basic fuel injection amount is a first injection conducted at an early stage of the intake stroke of the current cycle or at a stage earlier than the intake stroke, and the fuel injector further performs a second injection later than the first injection and during the intake stroke of the current cycle;

a second fuel injection amount for the second injection is determined based on variations in the second throttle opening TH1, and a third throttle opening TH2 which is defined subsequent to the second throttle opening TH1; and the third throttle opening TH2 is one of a throttle opening at and before the maximum lift of the intake valve.

8. The internal combustion engine according to claim 7, wherein the first throttle opening TH0 is set to the throttle opening at or after the full closing of the intake valve in the previous cycle.

9. An internal combustion engine comprising an intake pipe;

a throttle valve including a throttle sensor which measures a throttle opening in said intake pipe;

a pressure sensor which senses an intake pipe internal pressure in said intake pipe;

a pulse sensor which calculates an engine rotary speed;

a fuel injector arranged in the intake pipe; and a fuel injection controller operatively connected to the fuel injector, the throttle valve, the pressure sensor and the pulse sensor;

said fuel injection controller comprising:

a basic fuel injection amount calculator which calculates a basic fuel injection amount to be drawn in an intake stroke of a current cycle based on an engine rotary speed and an intake pipe internal pressure PB in an intake stroke of a previous cycle;

a fuel injection amount corrector which makes a correction to the basic fuel injection amount based on variations in a first throttle opening TH0 and a second throttle opening TH1, which occurs immediately before the calculation of the basic fuel injection amount;

wherein the first throttle opening TH0 occurs before the second throttle opening TH1, wherein the intake pipe internal pressure PB of the previous cycle takes on a peak value of the intake pipe internal pressure PB, and wherein the first throttle opening TH0 is set to a time later than the peak value of the intake pipe internal pressure PB, and wherein when fuel is injected twice per cycle of the engine:

a first fuel injection amount including the basic fuel injection amount and said correction to the basic fuel injection amount is a first injection conducted at an early stage of the intake stroke of the current cycle or at a stage earlier than the intake stroke, and the fuel injector further performs a second injection later than the first injection and during the intake stroke of the current cycle;

a second fuel injection amount for the second injection is determined based on variations in the second throttle opening TH1, and a third throttle opening TH2 which is defined subsequent to the second throttle opening TH1; and the third throttle opening TH2 is one of a throttle opening at and before the maximum lift of the intake valve.

10. The internal combustion engine according to claim 9, wherein the first throttle opening TH0 is set to the throttle opening at or after the full closing of the intake valve in the previous cycle.

11. The internal combustion engine according to claim 9, wherein one of a common throttle opening map Mp and a formula is used for determining said correction to the first fuel injection amount in the first injection, and a correction to the second fuel injection amount for the second injection.

* * * * *